US007895958B2

(12) United States Patent
Cho

(10) Patent No.: US 7,895,958 B2
(45) Date of Patent: Mar. 1, 2011

(54) APPARATUS AND METHOD FOR DETECTING AN ENDING-POINT OF BOBBIN THREAD FOR SEWING MACHINE USING BAR CODE

(76) Inventor: Hoon Sik Cho, Gimhae-si (KR)

( * ) Notice: Subject to any disclaimer, the term of this patent is extended or adjusted under 35 U.S.C. 154(b) by 132 days.

(21) Appl. No.: 12/299,225

(22) PCT Filed: Mar. 2, 2007

(86) PCT No.: PCT/KR2007/001046

§ 371 (c)(1),
(2), (4) Date: Oct. 31, 2008

(87) PCT Pub. No.: WO2007/126205

PCT Pub. Date: Nov. 8, 2007

(65) Prior Publication Data

US 2010/0154694 A1 Jun. 24, 2010

(30) Foreign Application Priority Data

May 3, 2006 (KR) ..... 10-2006-0040204
Jul. 12, 2006 (KR) ..... 10-2006-0065532

(51) Int. Cl.
*B65H 63/00* (2006.01)
*D05B 69/36* (2006.01)

(52) U.S. Cl. ..... 112/273; 112/278; 112/470.01

(58) Field of Classification Search ..... 112/273, 112/278, 279, 470.01; 242/118.3, 118.32, 242/118.4; 200/61.5–61.6
See application file for complete search history.

(56) References Cited

U.S. PATENT DOCUMENTS

| | | | | | |
|---|---|---|---|---|---|
| 4,166,423 | A | * | 9/1979 | Brienza et al. | 112/278 |
| 4,301,757 | A | * | 11/1981 | Tonomura | 112/254 |
| 4,805,544 | A | * | 2/1989 | Dobner et al. | 112/278 |
| 4,934,292 | A | * | 6/1990 | Mardix et al. | 112/273 |
| 5,161,475 | A | * | 11/1992 | Tawara et al. | 112/278 |
| 5,211,121 | A | * | 5/1993 | Sakakibara | 112/278 |
| 5,267,518 | A | * | 12/1993 | Arnold et al. | 112/273 |
| 5,350,127 | A | * | 9/1994 | Arnold et al. | 112/279 |
| 5,353,726 | A | * | 10/1994 | Bruder et al. | 112/278 |
| 6,170,418 | B1 | * | 1/2001 | Jaeger | 112/475.01 |
| 7,798,081 | B2 | * | 9/2010 | Yoon | 112/273 |

FOREIGN PATENT DOCUMENTS

| | | |
|---|---|---|
| JP | 64-027587 | 1/1989 |
| JP | 04-215794 | 8/1992 |
| JP | 06-047183 | 2/1994 |
| WO | WO 98-21389 | 5/1998 |

* cited by examiner

*Primary Examiner* — Gary L Welch
*Assistant Examiner* — Nathan E Durham
(74) *Attorney, Agent, or Firm* — Park & Associates IP Law LLC

(57) ABSTRACT

The present invention relates to an apparatus and a method for detecting the ending-point of a bobbin thread for a sewing machine using a bar code, which is capable of alerting a sewing operator of his/her desiring bobbin thread remains when they are left enough to finish sewing under operation. The present invention of the apparatus for detecting the ending-point of a bobbin thread for a sewing machine using a bar code so as to sense the ending-point of a bobbin thread during a sewing operation, comprises a bobbin to wind a bobbin thread therearound and at least one bar code to indicate a position in the surface of a bobbin, of which the bar code is printed on one or both side(s).

7 Claims, 1 Drawing Sheet

[Fig. 1]
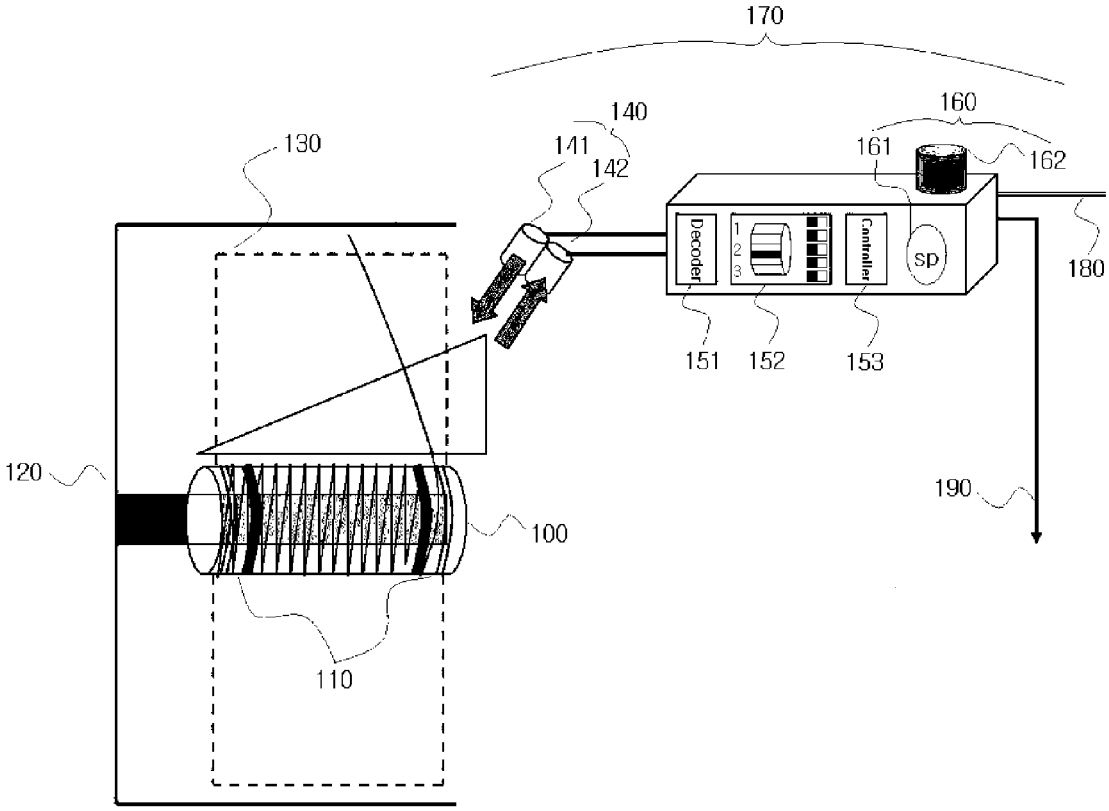
[Fig. 2]
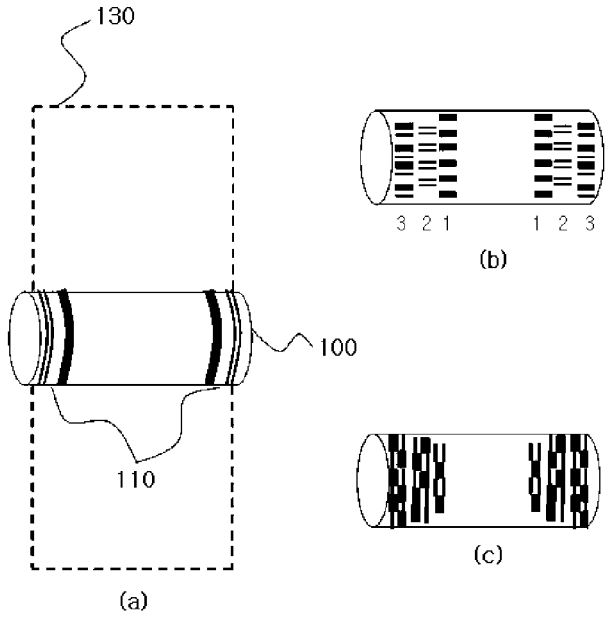

APPARATUS AND METHOD FOR DETECTING AN ENDING-POINT OF BOBBIN THREAD FOR SEWING MACHINE USING BAR CODE

FIELD OF THE INVENTION

The present invention relates to an apparatus and a method for detecting the ending-point of a bobbin thread for sewing machine using bar code, which is capable of alerting a sewing operator of his/her desiring bobbin thread remains when they are left enough to finish sewing under operation.

In the meantime, the present invention can be utilized by applying to the invention with the title of "Method for Winding an Under-thread of Sewing Machine and the Bobbin Wound with the Under-thread by the Method", of which the Korean Patent Application was filed on Jul. 12, 2006 (Application No. 10-2006-0065480) with Korean Intellectual Property Office.

BACKGROUND OF THE INVENTION

A top thread is generally of a great length by 3000 m to 4000 m and visible so that it rarely causes the problem of its running out. However, A bobbin thread is inevitably so short by 20 m to 50 m that it has to be changed quite often with another one, which ends up resulting in the unavoidable problem of uncertainty in determining when to change a run-out bobbin thread with a new one.

Herein lies the reason that a bobbin thread is inevitably short and should be frequently replaced: When a bobbin thread is stitched in lockstitch with a top thread with the help of rotation of a hook-set according to the working properties of a sewing machine, the size of a hook-set and the space for the bobbin thread to be placed are too limited to be enlarged infinitely.

In determining the timing of replacing a run-out bobbin thread with a new one, a sewing operator can reduce the problems caused by running out of a bobbin thread, by precisely recognizing its finishing point before its running out.

Failure of sensing the ending point of a bobbin thread causes a sewer to a loose stitch without a bobbin thread after its finishing up, and it thus results in defective products. In addition, as a connected sewing is followed with a second bobbin thread replaced after the finish up of a first bobbin thread, it results in the problem of the seam opening in high tension requiring products such as air bags, footwear, swimwear, and the like.

Most of the conventional apparatuses for solving such problems generally detect the ending point of a bobbin thread making use of an optical sensor. Such devices, however, have a drawback of low degree of accuracy in sensing the finishing point of a bobbin thread. That is because those detecting apparatuses using an optical sensor may be able to begin to transmit or reflect the light even when a bobbin thread is not finished up, but partially undone.

BRIEF SUMMARY OF THE INVENTION

Technical Problem

It is an object of the present invention to provide an apparatus and a method for detecting the ending-point of a bobbin thread for sewing machine using a bar code, which is capable of alerting a sewing operator of his/her desiring bobbin thread remains when they are left enough to finish sewing under operation.

Technical Solution

The object of this invention is attained by an apparatus for detecting the ending-point of a bobbin thread for a sewing machine using a bar code so as to sense the ending-point of a bobbin thread during a sewing operation, comprises a bobbin to wind a bobbin thread therearound and at least one bar code to indicate a position in the surface of a bobbin, of which the bar code is printed on one or both side(s).

The object of this invention is also attained by a method for detecting the ending-point of a bobbin thread for a sewing machine using a bar code so as to sense the ending-point of a bobbin thread during a sewing operation, which comprises the steps of sensing by reading the bar code value of exposed part of the surface of a bobbin undone with a bobbin thread; converting the said bar code value into a digital value; comparing the said digital value with a preset dial value which indicates the position in the surface of a bobbin; and expressing the corresponding of the said digital value to the said dial value.

The object of this invention is further attained by a method for detecting the ending-point of a bobbin thread for a sewing machine using a bar code so as to sense the ending-point of a bobbin thread during a sewing operation, which comprises the steps of securing of a signal of cutting of a bobbin thread by a trimming device, and stopping a sewing machine responding to the said cutting signal or expressing the ending of the said bobbin thread by at least one way of a speaker, an LED or an LCD.

ADVANTAGEOUS EFFECTS

The present invention of an apparatus and a method for detecting the ending-point of a bobbin thread for a sewing machine using a bar code, has advantageous effects of preventing product defects caused by a loose stitch without a bobbin thread and a seam opening resulted from continued sewing with a new bobbin thread after the finish-up of a previous bobbin thread, by alerting a sewing operator of the ending-point of a bobbin thread in advance.

In addition, the present invention has another advantageous effects of promoting sewing efficiency by providing a sewer with the function of sensing his/her desiring bobbin thread remains by various degrees of length such as long, medium, or short.

BRIEF DESCRIPTION OF THE DRAWINGS

FIG. 1 is a view showing the configuration of an apparatus for detecting the ending-point of a bobbin thread according to an embodiment of the present invention; and FIG. 2 is a view showing a bobbin according to an embodiment of the present invention.

EXPLANATION ON THE REFERENCE NUMERALS IN THE MAIN PARTS OF THE DRAWINGS

100: bobbin 110: bar code 120: bobbin case

130: full size of bobbin thread (before use) 140: sensing unit 141: light-emitting unit

142: light-receiving unit 151: decoder 152: setting unit

153: controller 160: alerting unit 161: speaker

162: light-emitting lamp 170: bar-code detector 180: power supply cable

190: signal line

DETAILED DESCRIPTION OF THE INVENTION

The terms and the words used in the specification and the claims should not be limitedly construed with ordinary or lexical meaning. Rather, they should be construed with the meanings and the conceptions according to the idea of the present invention, abiding by the principle that an inventor can properly define the conception of terms so as to describe his or her own invention with the best manner.

While the present invention has been described with reference to particular illustrative embodiments, it is not to be restricted by the embodiments but only by the appended claims. It is to be appreciated that those skilled in the art can change or modify the embodiments without departing from the scope and spirit of the present invention.

Hereinafter, the preferred embodiments of the present invention will be described in detail with reference to the accompanying drawings.

FIG. 1 is a view showing the configuration of an apparatus for detecting the ending-point of a bobbin thread according to an embodiment of the present invention. Referring to FIG. 1, an apparatus for detecting the ending-point of a bobbin thread comprises a bobbin (100) wound with a bobbin thread and a bar-code detector (170) for detecting the ending-point of a bobbin thread wound around a bobbin (100) and alerting a sewer of the ending-point.

A bobbin (100) can be an 'H'-shaped or a straight tube structure for winding a bobbin thread therearound.

A bar code (110) is printed on one side or both sides of the surface of a bobbin (100). The bar code (110) may be one-dimensional or two-dimensional one for detecting a portion of the surface of a bobbin (100) by reading the bar code exposed as a bobbin thread being undone around a bobbin (100).

The bar code (110) expresses characters or numbers with UPC, CODE39. In addition, the bar code (110) can be a type of expressing plural degrees, not a general one containing a singular code showing the start and the end. Therefore, the bar code (110) can be one expressing even simple numbers.

The bar-code detector (170) comprises a sensing unit (140), a decoder (151), a controller (153), and a alerting unit (160).

The sensing unit (140) includes a light-emitting unit (141) and light-receiving unit (142) for reading the bar code (110) printed on the surface of a bobbin (100). The decoder (151) converts the value of the bar code read through the sensing unit (140) into a digital value. The controller (153) makes a speaker (161) or a light-emitting lamp (162) operate according to the comparing of the converted digital value with preset dial value. The alerting unit (160) can be the speaker (161) or the light-emitting lamp (162) operating as the result of the comparison of the controller (153).

Herein the said dial value corresponds to a certain portion of the surface of a bobbin (100). That is, a value which is preset in the setting unit (152) by a sewer in order to inform him/her of his/her desiring bobbin thread remains.

More specific explanation is following.

When a light-emitting unit (141) emits light toward a bobbin (100), the surface of the bobbin (100) reflects the light and a light-receiving unit (142) receives the light and thus reads a bar code (110). The analog value of the read bar code (110) is amplified by an amplifier (not shown in the drawings). The amplified analog value is converted into a digital value by a decoder (151), and the digital value is a precise number expressing a certain portion of the surface of a bobbin (100).

A sewer can preset, through a setting unit (152), when the alerting about the ending-point of a bobbin thread is given. That is, a sewing operator can preset through the setting unit (152) his desiring thread remains, the volume of alarming sound, the type of the alerting (sound or light-emitting), timing of the alerting, and the like.

Herein the timing of the alerting can be divided into 'under operation' and 'right after finishing an operation'. Giving the alarm under operation is for informing a sewer that there remains a certain amount of a bobbin thread while sewing is under operation. The steps of alerting are following. First, the timing of alerting while a sewing being under operation is set through a setting unit (152). Next, the dial value, the set timing of alerting, is compared with the digital value which is converted from the read bar code (110) on the surface of the bobbin (100). Last, according to the result of the said comparison, an alarm may be given to a sewer so as to inform him/her of the preset amount of a bobbin thread remains.

That is, the digital value, which is converted through a decoder (151) after the bar code (110) being read, is transmitted to a controller (153). In the controller (153), the digital value is compared and found whether to agree with a dial value, the preset value through the setting unit (152). When the said digital value agrees with the dial value as the result of comparison, the controller (153) operates a speaker (161) or a light-emitting lamp (162), the alerting unit (160). Herein the alerting unit (160) is not limited to a speaker (161) or a light-emitting lamp (162), but can be various embodiments such as an LCD or an LED.

When the alerting right after finishing an operation (between operations) is given, the main body which will operate an alarm can be limited to a bar-code detector (170) or a sewing machine (not shown in the drawings).

As the bar-code detector (170) has detected the ending-point of a bobbin thread, it keeps the memory of the detection in a controller (153); and when the operation ends, it transmits the ending signal to the sewing machine in order for a trimming device (not shown in the drawings) to cut the bobbin thread. Then, according to the cutting signal of the trimming device, a controlling unit installed in the sewing machine operates alarms in the sewing machine. As the bar-code detector (170) receives the cutting signal from the trimming device in a sewing machine, it also can operate its alarm(s) such as a speaker (161) or a light-emitting lamp (162). For such operation, the bar-code detector (170) is preferably connected to a sewing machine wirelessly or wiredly (190). Meanwhile, according as a sewing machine or a bar-code detector receives the cutting signal from the trimming device, which is the timing of ending the sewing operation continued after detecting the ending-point of a bobbin thread, the sewing machine or the bar-code detector gives the alarm of its own that the operation ends, and stops the sewing machine. Thus it is possible to prevent a loose stitch without a bobbin thread which may happen after a bobbin thread has been used up.

Giving the alarm right after finishing an operation described above can be adopted in the case of when a bobbin thread remains are enough to finish the sewing under operation, and thus it doesn't cause unnecessary anxiety to a sewer by giving unnecessary alarms to the sewer during his/her sewing operation.

FIG. 2 is a view showing a bobbin according to an embodiment of the present invention. Referring to FIG. 2, (a) is a vertical one-dimensional bar code (110) with thick and thin straight bar, (b) is horizontal one-dimensional bar code (110), and (c) is two-dimensional bar code (110).

Such a bar code (110) is printed on a certain portion of the one side or the both sides of the surface of a bobbin (100) with the value indicating its own position. As the bobbin thread wound around a bobbin (100) is undone by being used up in a sewing operation, the bar code (110) on the surface of a bobbin (100) is thus exposed to be read by the bar-code detector (170).

For example, the value of the position on the surface of a bobbin (100) can be set by three steps, which is for alerting of the ending-point of a bobbin thread. As the bobbin thread wound around a bobbin (100) is undone starting from the out side of its surface, the bar code (110) on the surface of the bobbin (100) can have the value of 0 through 2 from the out side toward the in side so as to indicate each position. That means that the bar-code detector (170) can read the bar code value 0 when the bobbin thread around the outermost part of the bobbin (100) is undone and the bar code is exposed. Next, the read value is converted into the binary number '00' of its digital value, and then compared with a preset dial value. As the result of that, if the read value corresponds to the said dial value, an alerting unit (160) is on operating. In the same manner, the position value 1 on the surface of the bobbin (100) is converted into the binary number '01', the position value 2 into the binary number '10' respectively of its own digital value to be made use of. This example shows an embodiment when the detected positions are divided into three steps, yet the detected positions can be divided into various steps to be sensed. Meanwhile, the bar code value can be set with specified values, not with sequential values like in the above embodiment.

Although the present invention has been described with reference to several preferred embodiments, the description is illustrative of the invention and is not to be construed as limiting the invention. Various modifications and variations may occur to those skilled in the art, without departing from the scope of the invention as defined by the appended claims.

The invention claimed is:

1. An apparatus for detecting an ending-point of a bobbin thread for a sewing machine, the apparatus comprising:

a bobbin having a thread winding surface to wind a bobbin thread there-around;

at least one bar code printed on one or both side areas in the thread winding surface of the bobbin to indicate a position in the bobbin where the bar code is printed; and a bar-code detector configured to read the bar code as a bobbin thread is unwinding to expose the bar code in order to sense an ending-point of the bobbin thread during a sewing operation.

2. The apparatus for detecting the ending-point of a bobbin thread according to claim 1, wherein the bar-code detector is further configured to inform a sewer of the running out of the bobbin thread.

3. The apparatus for detecting the ending-point of a bobbin thread according to claim 1, wherein the bar-code detector comprises:

a sensing unit to read the bar code;

a decoder to convert the value of the read bar code into a digital value; and an alerting unit operating according to the digital value, to inform a sewer of the running out of the said bobbin thread.

4. The apparatus for detecting the ending-point of a bobbin thread according to claim 3, wherein the bar code is printed with sequential values or specified values corresponding to relative positions in the bobbin.

5. The apparatus for detecting the ending-point of a bobbin thread according to claim 4, the apparatus further comprising:

a setting unit to set a dial value corresponding to a selected position from the relative positions in the bobbin; and a controller to operate the alerting unit when the digital value corresponds to the dial value set with the setting unit.

6. A method for detecting an ending-point of a bobbin thread for a sewing machine, the method comprising the steps of:

providing at least one bar code printed on one or both side areas in a thread winding surface of a bobbin to indicate a position in the bobbin where the bar code is printed;

sensing by reading the printed bar code value in an exposed part of the thread winding surface of the bobbin as a bobbin thread is unwinding to expose the bar code;

converting the sensed bar code value into a digital value;

comparing the digital value with a preset dial value which indicates a selected position in the bobbin; and providing an alerting signal to inform running out of the bobbin thread when the digital value corresponds to the preset dial value.

7. The method of claim 6, the alerting signal is provided in form of an alerting sound or an alerting light by an alerting unit.

* * * * *